US011053957B2

(12) United States Patent
Helbig et al.

(10) Patent No.: US 11,053,957 B2
(45) Date of Patent: Jul. 6, 2021

(54) ACTUATING DRIVE HAVING A HYDRAULIC OUTFLOW BOOSTER

(71) Applicant: MOOG GmbH, Boeblingen (DE)

(72) Inventors: Achim Helbig, Stuttgart (DE); Sascha Dany, Detzem (DE); Udo Koelbl, Leonberg (DE); Werner Haendle, Marbach a.N. (DE)

(73) Assignee: Moog GmbH, Boeblingen (DE)

( * ) Notice: Subject to any disclaimer, the term of this patent is extended or adjusted under 35 U.S.C. 154(b) by 0 days.

(21) Appl. No.: 16/772,246

(22) PCT Filed: Dec. 14, 2018

(86) PCT No.: PCT/EP2018/085037
§ 371 (c)(1),
(2) Date: Jun. 12, 2020

(87) PCT Pub. No.: WO2019/121416
PCT Pub. Date: Jun. 27, 2019

(65) Prior Publication Data

US 2021/0095698 A1 Apr. 1, 2021

(30) Foreign Application Priority Data

Dec. 21, 2017 (DE) ..... 102017131004.5

(51) Int. Cl.
*F01D 17/26* (2006.01)
*F15B 11/08* (2006.01)
*F15B 21/14* (2006.01)

(52) U.S. Cl.
CPC ..... *F15B 11/08* (2013.01); *F01D 17/26* (2013.01); *F15B 21/14* (2013.01);
(Continued)

(58) Field of Classification Search
CPC ..... F15B 21/14; F15B 2211/20561; F15B 2211/20515; F15B 2211/27; F01D 17/26; F01D 21/18
See application file for complete search history.

(56) References Cited

U.S. PATENT DOCUMENTS 4,589,444 A * 5/1986 Masek ..... F01D 17/145 137/613
5,095,804 A * 3/1992 Burch ..... F15B 13/02 91/361

(Continued)

*Primary Examiner* — Thomas E Lazo
(74) *Attorney, Agent, or Firm* — Harter Secrest & Emery LLP

(57) ABSTRACT

An electro-hydrostatic actuating drive has a variable-volume and/or variable-speed hydraulic machine, which is driven by an electric motor, for the provision of a volumetric flow of a hydraulic fluid. Furthermore, the actuating drive comprises a cylinder with a piston, a piston rod and a first piston chamber, a valve with a first position and a second position, which valve can be moved by a first hydraulic actuator into the first position and by a second hydraulic actuator into the second position, wherein the second position controls a greater volumetric flow of the hydraulic fluid than the first position, a sink, a main line which connects a first piston chamber of the cylinder to the sink and in which the hydraulic machine is arranged, an auxiliary line which connects the first piston chamber to the sink and in which the valve is arranged, a first control line to the first hydraulic actuator, and a second control line to the second hydraulic actuator. A hydraulic resistor is arranged in the main line in series with the hydraulic machine, the first control line is connected to the main line, and the second control line is connected between the hydraulic resistor and the first piston chamber.

17 Claims, 3 Drawing Sheets

Figure 1:
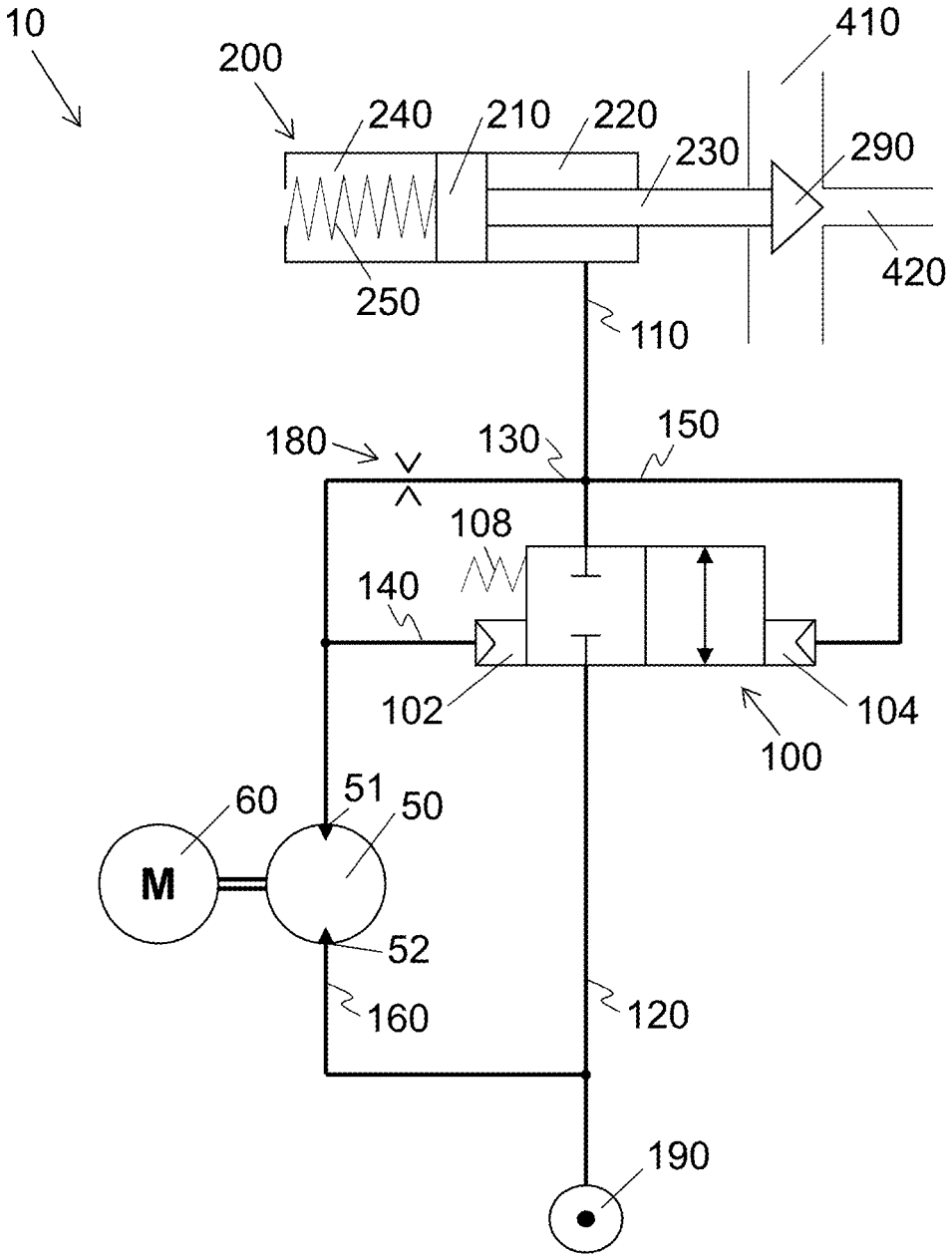

(52) U.S. Cl.
CPC ..... *F15B 2211/20515* (2013.01); *F15B 2211/20561* (2013.01); *F15B 2211/20576* (2013.01); *F15B 2211/27* (2013.01); *F15B 2211/411* (2013.01); *F15B 2211/428* (2013.01)

(56) References Cited

U.S. PATENT DOCUMENTS 5,137,253 A * 8/1992 Frey ..... F01D 17/26 251/29
5,435,227 A * 7/1995 Frey ..... F01D 21/18 91/1
8,776,513 B2 * 7/2014 Nishioka ..... F15B 11/0423 60/478
9,360,028 B2 * 6/2016 Zwingler ..... F15B 15/20

* cited by examiner

ACTUATING DRIVE HAVING A HYDRAULIC OUTFLOW BOOSTER

The present invention relates to an actuating drive having a variable-speed pump, as used, for example, in steam turbines, gas turbines, die casting machines.

Actuating drives are known in the prior art. EP 0 604 805 A1 discloses an actuating device for a hydraulic actuating drive with a pressure-proportional actuating signal, with which a piston-cylinder arrangement acting as a transducer is interposed between actuating drive and a hydraulic outflow booster.

This device has, among other things, the following disadvantages: The oil circuit is not closed and requires a fairly constant volume of oil. An external pressure supply is required for the function. Based on this prior art, it is an object of the present invention to at least partially overcome or improve upon the disadvantages of the prior art.

The object is achieved with a device according to claim 1. Preferred embodiments and modifications are the subject matter of the sub-claims.

An electro-hydrostatic actuating drive according to the invention has a variable-volume and/or variable-speed hydraulic machine, which is driven by an electric motor, for the provision of a volumetric flow of a hydraulic fluid. Furthermore, the actuating drive comprises a cylinder having a piston, a piston rod and a first piston chamber. In addition, a valve having a first position and a second position, which can be moved by a first hydraulic actuator into the first position and by a second hydraulic actuator into the second position, wherein the second position controls a greater volumetric flow of the hydraulic fluid than the first position. The actuating drive has a sink, a main line which connects a first piston chamber of the cylinder to the sink and in which the hydraulic machine is arranged, an auxiliary line which connects the first piston chamber to the sink and in which the valve is arranged, a first control line to the first hydraulic actuator, and a second control line to the second hydraulic actuator.

The actuating drive is characterized in that a hydraulic resistor is arranged in series with the hydraulic machine in the main line, the first control line is connected to the main line, and the second control line is connected between the hydraulic resistor and the first piston chamber. The cylinder can be used, for example, for controlling the hydraulics of a gas turbine or die casting machine. In this case, the hydraulic supply or outflow is controlled by a closure, which is arranged on the piston rod of the cylinder. With such machines, the situation arises that the hydraulic supply or outflow has to be blocked very rapidly. For this very rapid discharge of the hydraulic fluid from the cylinder, the actuating drive releases a hydraulic path which ensures a high flow of hydraulic fluid from the cylinder to a sink. The sink is part of a closed hydraulic system. It can be realized, for example, as a reservoir closed off from the surrounding area. By implementing the actuating drive as a closed hydraulic system, the required oil volume can be significantly reduced in comparison with the prior art. This also reduces the risk for the surrounding area, for example when the system leaks, because the lower amount of oil, for example, reduces the risk of fire or also simplifies the measures for avoiding contamination, because a smaller space is to be surrounded.

The first piston chamber of the cylinder is filled by the hydraulic machine or the pump via the main line. Thereby, the hydraulic fluid is removed from the sink. In order to evacuate the first piston chamber rapidly, the actuator has a secondary line which has a higher, in particular significantly higher, cross-section than the main line. This auxiliary line connects the first piston chamber to the sink.

A hydraulic valve is arranged in the auxiliary line. The valve can be implemented in quite different embodiments. In all embodiments, the valve has a first position and a second position, wherein the second position controls a greater volume flow of the hydraulic fluid than the first position. Thus, in one embodiment, the valve may have a first "locked" position and a second "flow" position. The hydraulic valve is controlled by hydraulic actuators. It may be movable from a first hydraulic actuator into the first position and from a second hydraulic actuator into the second position. A first control line leads to the first hydraulic actuator and a second control line leads to the second hydraulic actuator.

A hydraulic resistor is arranged in series with the hydraulic machine in the main line. The order of the arrangement plays a subordinate role; in this way, either the hydraulic machine or the hydraulic resistor can be arranged closer to the sink. The first control line is connected to the main line, for example, between the hydraulic resistor and the sink, and the second control line is connected between the hydraulic resistor and the first piston chamber. When the first piston chamber is to be emptied rapidly, the hydraulic machine initially sucks the hydraulic fluid from the first piston chamber via the main line. For the sake of clarity, it is assumed that the volumetric flow in the main line is gradually increased. At a predefined volumetric flow, depending on the volumetric flow, an increased pressure arises in the second control line, which is connected between the hydraulic resistor and the first piston chamber. Due to this increased pressure, the second hydraulic actuator moves the valve into the second position. In one embodiment, the valve may thereby be moved from a first "locked" position into a second "flow" position. In some embodiments, the first "locked" position may be the rest position of the valve, in which the valve is initially retained, for example by means of a valve spring. In this case, at least the counter-force of the spring must be overcome by the pressure at the second hydraulic actuator.

Since the valve has been moved into the second position—by means of the second hydraulic actuator—the volumetric flow in the secondary line increases. In one embodiment, with which the valve is moved from a first "locked" position to a second "flow" position, the volumetric flow from the first piston chamber is virtually abruptly increased. As a result of this very rapid outflow of the hydraulic fluid from the cylinder, the actuating drive unblocks a hydraulic path which blocks the supply or outflow, for example of the hydraulics of a gas turbine or die-casting machine, very rapidly. In some embodiments, this effect can also be intensified in that an energy accumulator, for example in the form of a spring, is arranged in or on the cylinder. This accelerates both the controlled supply or outflow and the emptying of the first piston chamber. It is within the meaning of the present invention if a correspondingly modified arrangement is not used for rapid emptying, but for rapid filling of the first piston chamber. It is also within the meaning of the present invention if a correspondingly modified arrangement is not used for rapid opening of the valve, but rather for rapid closure of the valve.

In one embodiment, the first control line is connected between the hydraulic resistor and the hydraulic machine. Thereby, hydraulic resistance is arranged between the hydraulic machine and the first piston chamber. This embodiment is preferably selected for actuating drives with which the hydraulic machine only has a pressure-resistant connection. The hydraulic resistor thus also functions as an instrument for reducing pressure.

In one embodiment, the first control line is connected between the hydraulic machine (50) and the first piston chamber (220). This embodiment is preferably selected for actuating drives in which the hydraulic machine has two pressure-resistant connections.

In one embodiment, the hydraulic resistor is a diaphragm valve. A diaphragm valve is a robust and easy-to-handle component that is well-established in hydraulics. It is available in various embodiments and can thus be adapted well to the requirements; in particular, the predefined volumetric flow, which triggers the switching of the valve, can thus be determined quite precisely. In some embodiments, the diaphragm valve may also be configured variably.

In one embodiment, the hydraulic resistor is integrated into the hydraulic machine. This enables in particular a particularly compact design of the actuating drive. In some embodiments, the hydraulic resistor may already be realized by the design of the hydraulic machine—for example, when an internal resistance is realized—such that no additional component is required.

In one embodiment, the sink is a reservoir. This enables cost-effective implementation of the actuating drive.

In one embodiment, the reservoir is pretensioned and in particular embodied as a pressure accumulator. This ensures a particularly compact design of the actuating drive and saves energy during the filling of the first piston chamber.

In one embodiment, the sink is the second piston chamber of the cylinder, wherein the cylinder is a synchronous cylinder. Thereby, the synchronous cylinder does not have to have an exact ratio 1:1 from the first to the second piston chamber. In one embodiment, it is also possible to combine the synchronous cylinder with a reservoir and/or an accumulator.

In one embodiment, the valve is a directional control valve, wherein the first position is "locked", and the second position is "flow". For example, the valve can be realized as a 2/2 directional control valve.

In one embodiment, the valve has a plurality of positions, each having different cross-sections. This is advantageous if the actuating drive is to implement a more complex control, for example a rapid but nevertheless soft control of the hydraulic supply or outflow of the controlled device.

In one embodiment, the valve can continuously switch between a plurality of positions, each having a different volumetric flow of the hydraulic fluid. In this case, "stepless" can also mean "very small steps". This is also an advantageous possibility for implementing more complex controls.

In one embodiment, the valve has the "locked" position as a resting position, in which it is held, in particular by a spring. On the one hand, this largely prevents the inadvertent triggering, for example the inadvertent opening, of the valve. The switching pressure of the valve can be set precisely by selecting the spring—in particular in combination with a defined diaphragm valve.

In one embodiment, the cylinder further comprises an energy accumulator and/or is connected to an energy accumulator. The energy accumulator can be a spring, for example. This can be arranged in the second piston chamber or in front of the first piston chamber. Such an energy accumulator significantly increases the reaction speed of the actuating drive.

In one embodiment, a further hydraulic resistor, in particular a diaphragm valve, is arranged in the auxiliary line (110, 120). This provides a defined maximum volumetric flow when the hydraulic fluid is discharged rapidly from the first piston chamber, that is, in particular when the valve—at least for some embodiments—is in the second "flow" position.

In one embodiment, a check valve is arranged parallel to the hydraulic resistor. As a result, the first piston chamber can be filled more rapidly, because the amount of filling is no longer limited exclusively by the hydraulic resistor.

In one embodiment, another check valve is arranged parallel to the pump. Cavitation of the hydraulic machine is thus avoided if the valve is opened to such an extent that the greater part of the hydraulic fluid flows through the auxiliary line and thus the hydraulic machine would be supplied with hydraulic fluid only inadequately.

In one embodiment, the cylinder further comprises end-position damping in the first piston chamber. A robust elastic material is preferably used for this purpose. This is particularly advantageous if the energy accumulator is designed as a spring. In such a case, the piston of the cylinder can impinge very hard on the inner wall of the cylinder and thus cause damage to the cylinder, at least in the medium-term. This is prevented by the end-position damping.

A system according to the invention is equipped with an electro-hydrostatic drive as described above. In this case, the cylinder—at least for some embodiments—controls a process valve, for example for a steam valve or a cast piston.

A system according to the invention or an electro-hydrostatic drive is used for steam turbines, gas turbines, die-casting machines or plastic injection-molding machines.

The invention is explained in the following on the basis of various exemplary embodiments, wherein it is noted that this example encompasses modifications or additions as they immediately are evident to the person skilled in the art. Moreover, this preferred embodiment is not a limitation of the invention, in that modifications and additions are within the scope of the present invention.

Figure 2:
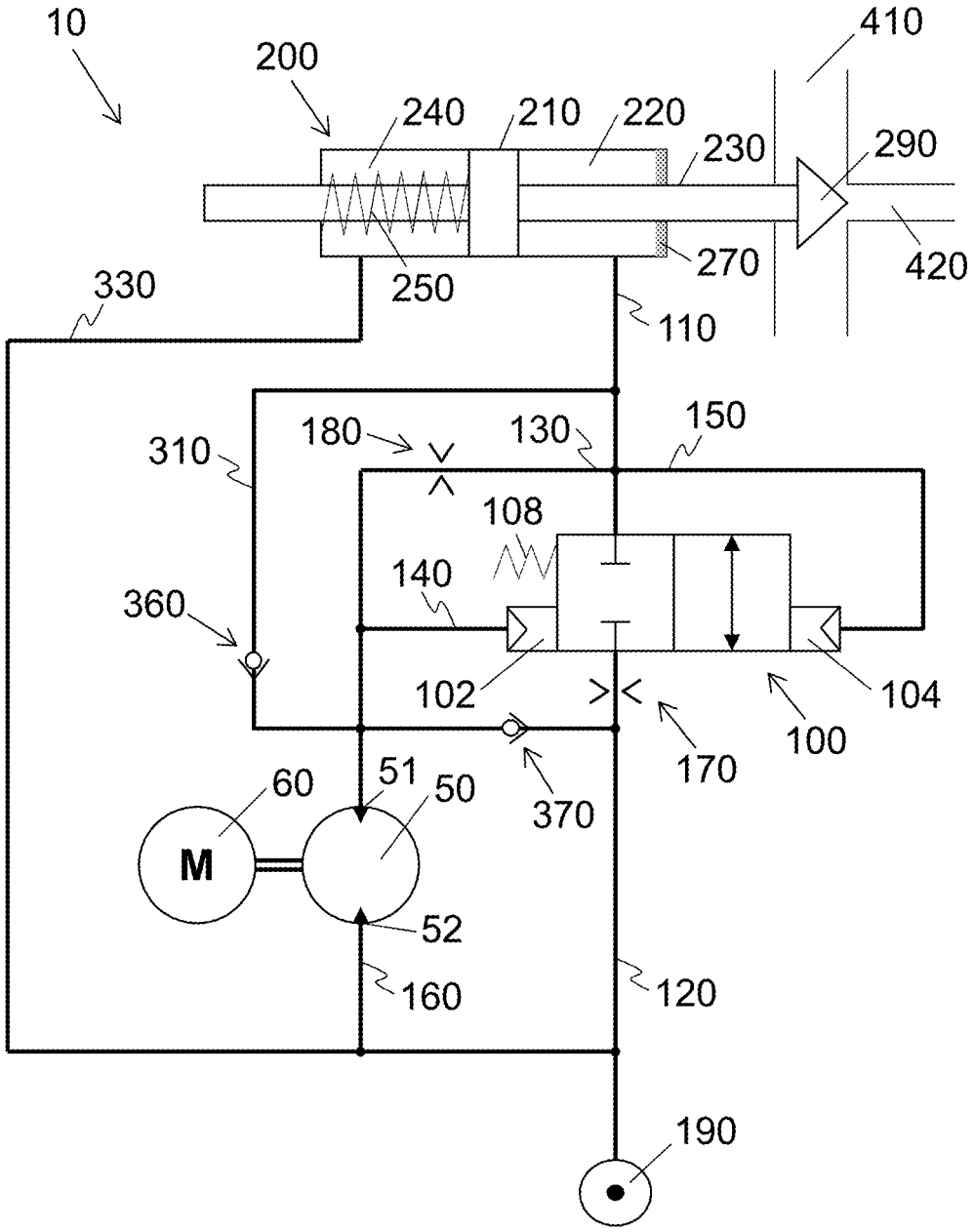
Figure 3:
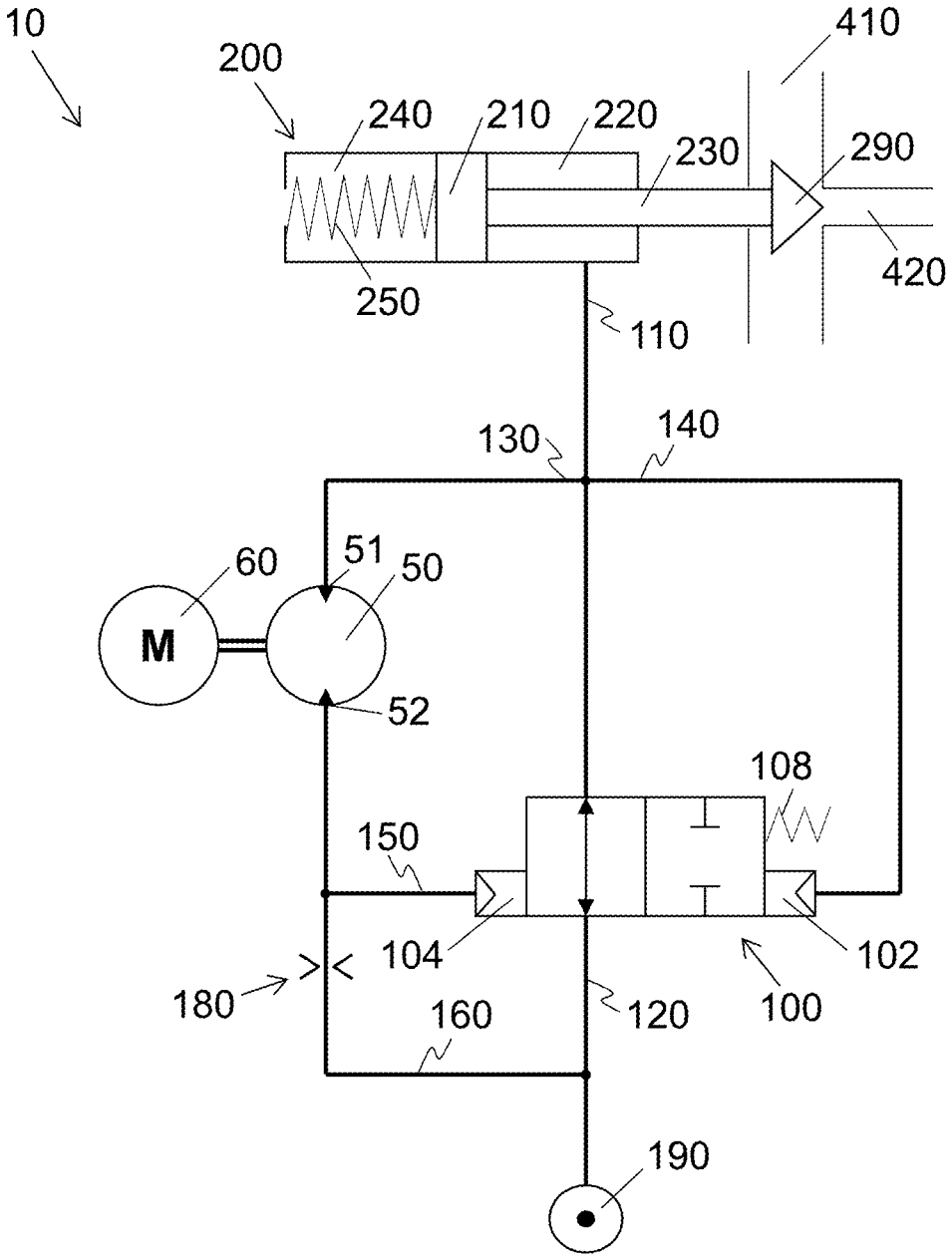

Thereby, the following are shown:

FIG. 1: A circuit diagram of an actuating drive according to the invention;

FIG. 2: A further embodiment of an actuating drive according to the invention;

FIG. 3: A further variant of an actuator according to the invention.

FIG. 1 shows a cylinder 200, whose piston rod 230 has an actuator, specifically a closure 290, at one end, as is used in particular for steam turbines, gas turbines, die-casting machines or plastic injection-molding machines. The closure 290 controls the opening of a line or passage 420 in one of the specified devices branching from another line or passage 410. In some operating modes, the opening to passage 420 should be closed very rapidly. In the embodiment shown, this takes place in that the first piston chamber 220 is emptied very rapidly and the spring 250 is relaxed very rapidly. The spring 250 is arranged within the second piston chamber 240 in this embodiment. The spring 250 functions as an energy accumulator. The second piston chamber 240 may be open. When the first piston chamber 220 is to be emptied very rapidly, the hydraulic machine or pump 50 first pumps hydraulic fluid from the first piston chamber 220 via the pressure lines 130 (which share a portion of the pressure line 110) and 160. The 2/2 directional control valve 100 is initially in the "locked" position. This is the rest position of the valve 100 and is ensured in this embodiment by a valve spring 108. The volumetric flow thereby produced in the pressure line 130 causes a pressure difference between a first and a second side of the diaphragm valve 180, that is, a higher pressure arises on the side of the diaphragm valve 180 which points in the direction of the first piston chamber 220. Consequently, a higher pressure also arises in the pressure line 140 which controls the actuator 102. The pressure is proportional to the volumetric flow generated by the pump 50. If the pump 50 exceeds a predefined volumetric flow, then the pressure in the line 140 is so high that the force of the valve spring 108 is overcome and the actuator 102 switches the valve 100 to the "flow" position. This opens the auxiliary lines 110 and 120, which have a much finer greater diameter than the pressure lines 130 and 160. As a result, the hydraulic fluid can very rapidly escape from the first piston chamber 220. In this embodiment, the hydraulic fluid enters the reservoir 190, which may be configured as a pressure chamber. The closed system advantageously allows a very compact design and requires a significantly lower volume of the hydraulic fluid than in the prior art.

The valve 100 is closed either by the valve spring 108 if the volumetric flow falls below a predefined limit, or the valve 100 is closed by the hydraulic machine 50 when the hydraulic machine 50 pumps the hydraulic fluid from the reservoir 190, via the lines 160 and 130, into the first piston chamber 220. This results in a higher pressure at the actuator 104, which switches the valve 100 into the "locked" position. The pump 50 is preferably realized as a variable-volume and/or variable-speed hydraulic machine 50 driven by an electric motor 60.

FIG. 2 shows another embodiment of an actuator according to the invention. The basic function is the same as explained for FIG. 1. The same reference signs also designate the same elements as in FIG. 1. FIG. 2, however, has further elements which are advantageous for specific use scenarios. FIG. 2 thus shows a pressure line 330 connecting the reservoir 190 and the second pump connection 52 to the second piston chamber 240. In some embodiments, the spring 250 may be omitted. This variant has the advantage that the reservoir 190 can be made smaller, because the second piston chamber 240 can receive part of the hydraulic fluid which is discharged from the first piston chamber 220.

Furthermore, FIG. 2 shows a check valve 360 in the pressure line 310, which opens when the first piston chamber 220 is filled with the hydraulic fluid. The check valve 360 is arranged in parallel with diaphragm valve 180. The check valve 360 thus bypasses the diaphragm valve 180, such that a more rapid filling of the first piston chamber 220 becomes possible.

FIG. 2 shows a check valve 370, which is arranged parallel to the hydraulic machine 50. The check valve 370 opens when the first piston chamber 220 is emptied. In this case, because the remainder of the hydraulic fluid will pass through the auxiliary lines 110 and 120, the pump 50 may have an undersupply of hydraulic fluid. With some types of pumps, this may result in damage to the pump. To avoid this, hydraulic fluid is directed from line 120 into pump 50 via the check valve 370.

In FIG. 2, a diaphragm valve 170 is arranged in the line 120. It is also possible to arrange the diaphragm valve 170 in line 110, preferably hydraulically in the vicinity of the valve 100. As a result, the maximum volumetric flow through the lines 110 and 120 is not determined by the cross-section of such lines, but can be determined much more precisely by the dimensioning of the diaphragm valve 170.

An end-position damping 270 is arranged in the cylinder 200 in the first piston chamber 220—in the region of the end opposite the spring 250. If, as in this embodiment, the energy accumulator is embodied as a spring 250, the piston of the cylinder can impinge very hard on the inner wall of the cylinder and thus cause damage to the cylinder, at least in the medium-term. This is avoided with the end-position damping 270 shown.

FIG. 3 shows another variant of an actuating drive according to the invention. As in FIG. 1, the valve 100 has the "locked" rest position. If the first piston chamber 220 is emptied, a pressure builds up upstream of the orifice valve 180 in the line 150, starting from a predefined volumetric flow, which pressure is so high that the force of the valve spring 108 is overcome and the actuator 104 switches the valve 100 into the "flow" position.

LIST OF REFERENCE SIGNS

10 Hydraulic system
50 Hydraulic machine, pump
51 First pump connection
52 Second pump connection
60 Motor
100 Valve, 2/2 directional control valve
102 First valve actuator
104 Second valve actuator
108 Valve spring
110, 120 Pressure line, auxiliary line
130, 160 Pressure line, main line
140, 150 Pressure line, control line
170 Further diaphragm valve
180 Diaphragm valve
190 Reservoir
200 Cylinder
210 Piston of the cylinder
220 First piston chamber
230 Piston rod
240 Second piston chamber
250 Spring
270 End-position damping
290 Closure
310 Pressure line
320 Pressure line
330 Pressure line
360 Check valve
370 Check valve
410, 420 Line, passage of controlled device

The invention claimed is:

1. An electro-hydrostatic drive for an actuating drive, comprising:

a variable-volume and/or variable-speed hydraulic machine which is driven by an electric motor for the provision of a volumetric flow rate of a hydraulic fluid, a cylinder having a piston, a piston rod and a first piston chamber;

a valve having a first position and a second position, which can be moved by a first hydraulic actuator to the first position and by a second hydraulic actuator to the second position, wherein the second position controls a greater volumetric flow of the hydraulic fluid than the first position, a sink, a main line which connects a first piston chamber of the cylinder to the sink and in which the hydraulic machine is arranged, an auxiliary line which connects the first piston chamber to the sink and in which the valve is arranged, a first control line to the first hydraulic actuator, and a second control line to the second hydraulic actuator, wherein a hydraulic resistor is arranged in the main line in series with the hydraulic machine, wherein the first control line is connected to the main line, and the second control line is connected between the hydraulic resistor and the first piston chamber; and the sink is the second piston chamber of the cylinder, wherein the cylinder is a synchronous cylinder.

2. The electro-hydrostatic drive according to claim 1, wherein the first control line is connected between the hydraulic resistor and the hydraulic machine.

3. The electro-hydrostatic drive according to claim 1, wherein the first control line is connected between the hydraulic machine and the first piston chamber.

4. The electro-hydrostatic drive according to claim 1, wherein the hydraulic resistor is a diaphragm valve.

5. The electro-hydrostatic drive according to claim 1, wherein the sink is a reservoir.

6. The electro-hydrostatic drive according to claim 5, wherein the reservoir is pre-tensioned and in particular embodied as a pressure accumulator.

7. The electro-hydrostatic drive according to claim 1, wherein the valve is a directional control valve, wherein the first position is "locked", and the second position is "flow".

8. The electro-hydrostatic drive according to claim 1, wherein the valve has a plurality of positions, each having different cross-sections.

9. The electro-hydrostatic drive according to claim 1, wherein the valve can continuously switch between a plurality of positions, each having a different volumetric flow of the hydraulic fluid.

10. The electro-hydrostatic drive according to claim 1, wherein the valve has the first "locked" position as the rest position, in which it is held, in particular by a spring.

11. The electro-hydrostatic drive according to claim 1, wherein the cylinder further comprises an energy accumulator.

12. The electro-hydrostatic drive according to claim 11, wherein the energy accumulator is a spring arranged in the second piston chamber or in front of the first piston chamber.

13. The electro-hydrostatic drive according to claim 1, wherein a further diaphragm valve is arranged in the auxiliary line.

14. The electro-hydrostatic drive according to claim 1, wherein a check valve is arranged parallel to the hydraulic resistor.

15. The electro-hydrostatic drive according to claim 1, wherein a further check valve is arranged parallel to the pump.

16. The electro-hydrostatic drive according to claim 1, wherein the cylinder further comprises an end-position damping in the first piston chamber.

17. The electro-hydrostatic drive according to claim 1, wherein the cylinder controls a process valve.

* * * * *